US005107558A

United States Patent [19]

Lück

[11] Patent Number: 5,107,558

[45] Date of Patent: Apr. 28, 1992

[54] MATTRESS WITH REMOVABLE INSERT

[76] Inventor: Werner Lück, Grüner Weg 6, W-4290 Bucholt, Fed. Rep. of Germany

[21] Appl. No.: 722,682

[22] Filed: Jun. 28, 1991

[30] Foreign Application Priority Data

Jul. 11, 1990 [DE] Fed. Rep. of Germany ..... 4022041
Sep. 21, 1990 [DE] Fed. Rep. of Germany ..... 4029947

[51] Int. Cl.[5] ..... A47C 27/14

[52] U.S. Cl. ..... 5/464; 5/465; 5/481; 5/448

[58] Field of Search ..... 5/498, 450, 464, 465, 5/470, 481

[56] References Cited

U.S. PATENT DOCUMENTS

| | | | |
|---|---|---|---|
| 3,604,025 | 9/1971 | Mions | 5/464 |
| 3,956,783 | 5/1976 | Stoller | 5/481 |
| 4,055,866 | 11/1977 | Evans | 5/465 X |
| 4,109,332 | 8/1978 | Luck | 5/481 X |
| 4,190,697 | 2/1988 | Ahrens | 5/481 X |
| 4,504,990 | 3/1985 | Scales et al. | 5/470 X |
| 4,628,557 | 12/1986 | Murphy | 5/464 X |
| 4,768,251 | 9/1988 | Baskent | 5/464 |
| 4,777,681 | 10/1988 | Lück | 5/464 |
| 4,957,804 | 9/1990 | Hendrix et al. | 5/448 X |

FOREIGN PATENT DOCUMENTS

| | | | |
|---|---|---|---|
| 230048 | 3/1963 | Austria . | |
| 0236668 | 8/1989 | European Pat. Off. . | |
| 7007643 | 3/1970 | Fed. Rep. of Germany . | |
| 8900196 | 4/1990 | Fed. Rep. of Germany . | |
| 1518845 | 7/1978 | United Kingdom | 5/464 |

*Primary Examiner*—Michael F. Trettel
*Attorney, Agent, or Firm*—Peter K. Kontler

[57] ABSTRACT

A mattress has a one-piece base of hollow fibers or polyurethane foam with a rectangular recess in the upper side of its torso supporting intermediate portion. The recess is filled by a removable insert wherein a fabric envelope contains a supply of fragmentized polyurethane foam and/or polypropylene beads or superimposed layers of foamed plastic material having different specific gravities and/or hardnesses. The base and the insert are confined in a mattress cover. The intermediate portion is harder than the leg supporting end portion of the base, and the intermediate portion has two rigid lateral sections which flank the recess between the leg supporting and head supporting end portions of the base.

23 Claims, 3 Drawing Sheets

F G.1

FIG. 6
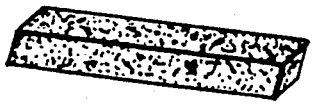
FIG. 7
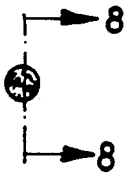
FIG. 8
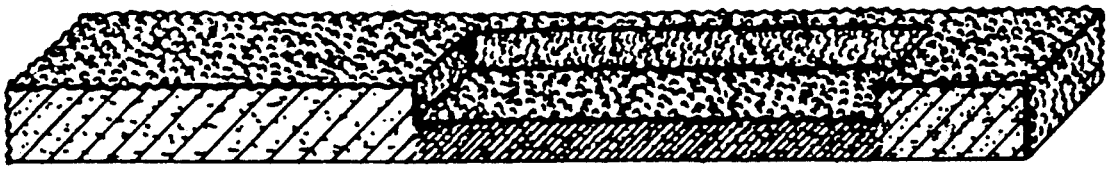
FIG. 9

MATTRESS WITH REMOVABLE INSERT

BACKGROUND OF THE INVENTION

The invention relates to mattresses in general, and more particularly to improvements in mattresses of the type wherein a base has a recess which is provided in its upper side and receives a removable insert, the base and the insert being confined in a mattress cover.

Commonly owned German Utility Model No. G 89 00 196 discloses a mattress wherein the base consists of a single piece of foamed material having a constant density. The upper side of the base is formed with an elongated recess which extends practically all the way between the foot end and the head end and serves to receive an insert of the type disclosed in commonly owned European Pat. No. 0 236 668. The insert has a covering which confines an envelope for several superimposed layers of foamed material.

Austrian Pat. No. 230048 to Liebknecht discloses a mattress wherein the base contains a first set of springs and the insert in the recess at the upper side of the base contains a second set of springs. The springs of the base beneath the recess are harder than the other springs of the base, and the recess extends substantially all the way from the foot end to the head end of the mattress. Two cushioning covers surround the base and the insert in its upper side. An impermeable partition is inserted into the recess to overlie the underside as well as the front and lateral sides of the insert.

German Utility Model No. 7007643 of de Smedt discloses a head support which can be used as a cushion and is made of a cellular elastic mass with a valley between two hills at its upper side. The valley receives the head of the person utilizing the cushion.

Commonly owned U.S. Pat. No. 4,777,681 discloses a cushion which contains a stuffing of foamed material. The patented cushion is intended for use in toys, beds, clothing, mattresses, motor vehicles and upholstered furniture. A case of the cushion contains a stuffing having one or more layers of foamed material with straight slits extending between opposite sides of the layer.

A drawback of presently known mattresses and their constituents is that they do not meet several often contradictory requirements, especially for use by patients afflicted with certain types of illnesses and infirmities. For example, a mattress should be reasonably hard but not so hard that the occupant is compelled to assume different positions at frequent intervals in order to relieve those parts of her or his body which were in contact with the upper side of the mattress. On the other hand, a satisfactory mattress should not be too soft because this would cause the body of the occupant to sink into the upper side of the mattress and to be impeded in her or his movements. Moreover, a relatively soft mattress interferes with the breathing of a substantial part of the skin of an occupant.

Furthermore, a satisfactory mattress should exhibit a highly localized elasticity, i.e., it should yield only at the very locus of application of a deforming force. The diameter of the deformed portion should be very small without a gradual and extended transition into the surrounding non-deformed areas. The construction should be such that the mattress will yield to the buttocks and to the hips of an occupant but its deformation should be much less pronounced or practically zero in the lumbar region of the person resting on the mattress.

Still further, a satisfactory mattress must satisfy certain biomechanical (i.e., orthopedic) requirements as well as certain physiological (microclimatic) desiderata.

OBJECTS OF THE INVENTION

An object of the invention is to provide a versatile mattress which can be rapidly converted to be optimally suited for use by persons having different problems and/or preferences.

Another object of the invention is to provide a novel and improved base for use in the above outlined mattress.

A further object of the invention is to provide a set of novel and improved inserts for use with the base of the above outlined mattress.

An additional object of the invention is to provide a mattress which can be utilized with advantage not only in private homes but also in hospitals, convalescent homes, retirement centers, nursing homes and similar establishments for sick, convalescing, old and other infirm persons.

Still another object of the invention is to provide a mattress which can be used to speed up the recovery of patients, to provide optimum comforts for all parts of the body of an occupant, which assists an attendant or a physician in carrying out various therapeutic treatments, which reduces the likelihood of bed sores, and which reduces the likelihood of other illnesses and/or infirmities as a consequence of prolonged occupancy.

A further object of the invention is to provide novel and improved materials and components for use in the base and/or in the insert of the improved mattress.

Another object of the invention is to provide a mattress which is designed to facilitate occupancy by a sitting person as well as the sitting down and getting up by a person desiring to occupy or to leave the mattress.

Another object of the invention is to provide a mattress which can be rapidly and conveniently sanitized when necessary.

An additional object of the invention is to provide a mattress wherein the base is designed to prevent undesirable shifting of the insert and/or undesirable shifting and/or wrinkling of the cover.

SUMMARY OF THE INVENTION

The invention is embodied in a mattress which comprises a relatively thin rectangular base including a head supporting first end portion, a relatively soft leg supporting second end portion and a relatively hard torso supporting intermediate portion. The upper side of the base is provided with a recess or socket within the intermediate portion, and the mattress further comprises an insert which is removably received in and at least substantially fills the recess, as well as a cover which surrounds the base and the insert in the recess. The base is preferably of one piece, and at least the intermediate portion of the base comprises two lateral sections which flank the recess between the two end portions of the base and have a width in the range of 5–15 cm, preferably about 10 cm. The lateral sections of the intermediate portion of the base are or can be substantially rigid so as to provide a rather solid support for the body of a person sitting on one of the lateral sections.

The base can contain or consist of polyurethane foam. Alternatively, the base can consist of or contain hollow fibers. The upper side of the base can be provided with an array of annular holes which may but need not extend all the way to the underside of the base.

In accordance with another presently preferred embodiment, the base comprises a plurality of thermally interconnected (fused or welded) superimposed layers of hollow fibers.

The intermediate portion of the base can be provided with a slightly convex bottom surface in the recess. The base can have a height of 11–17 cm, preferably about 14 cm, and the recess can have a substantially rectangular outline. It is presently preferred to dimension the recess in such a way that it has a length of 80–100 cm (preferably about 90 cm) between the two ends of the base, a width of 60–80 cm (preferably about 70 cm), and a depth of 5–9 cm (preferably about 7 cm).

The upper side of the base and/or the bottom surface of the intermediate portion of the base in the recess can be rough or roughened in parts. For example, the upper side of the base and/or the bottom surface of the recess can have a napped finish.

The insert can comprise an envelope of textile material and a supply of fragments consisting of polyurethane foam and filling the envelope. At least some of these fragments can have a substantially rhomboidal shape and each such fragment can have a plurality of gas filled (e.g., air filled) pores.

Alternatively, the insert can comprise a plurality of superimposed layers which are removably confined in an envelope, which consist of foamed material and which have different bulk densities and/or different hardnesses. These layers can include neighboring first and second layers which progressively conform to each other.

For example, the insert can include a lower layer having a first specific gravity and an upper layer which overlies the lower layer and has a lower second specific density. Such layers can be made of foamed material and have spaced-apart portions which are connected to each other, e.g., by thermal bonding or by stitches. The insert can further comprise one or more rows of stitches which connect the envelope to at least one of the two layers.

It is also possible to employ an insert which comprises a textile envelope and a supply of fragments of polyurethane foam and polypropylene beads. The beads are preferably intermixed with the fragments of polyurethane foam, and at least some of these fragments can have a substantially rhomboidal shape. Each fragment can have a plurality of gas filled pores (e.g., closed pores which contain air).

The filler (such as the aforediscussed layers) of the insert can be confined in an elastic envelope.

The novel features which are considered as characteristic of the invention are set forth in particular in the appended claims. The improved mattress itself, however, both as to its construction and the mode of using and converting the same, together with additional features and advantages thereof, will be best understood upon perusal of the following detailed description of certain presently preferred specific embodiments with reference to the accompanying drawing.

BRIEF DESCRIPTION OF THE DRAWING

FIG. 6 is a perspective view of a rhomboidal fragment of foam;

FIG. 7 is an elevational view of a bead;

FIG. 8 is a sectional view as seen in the direction of arrows from the line 8—8 of FIG. 7; and FIG. 9 is a perspective view of a mattress having a n upper side with a napped finish.

DESCRIPTION OF PREFERRED EMBODIMENTS

Figure 1:
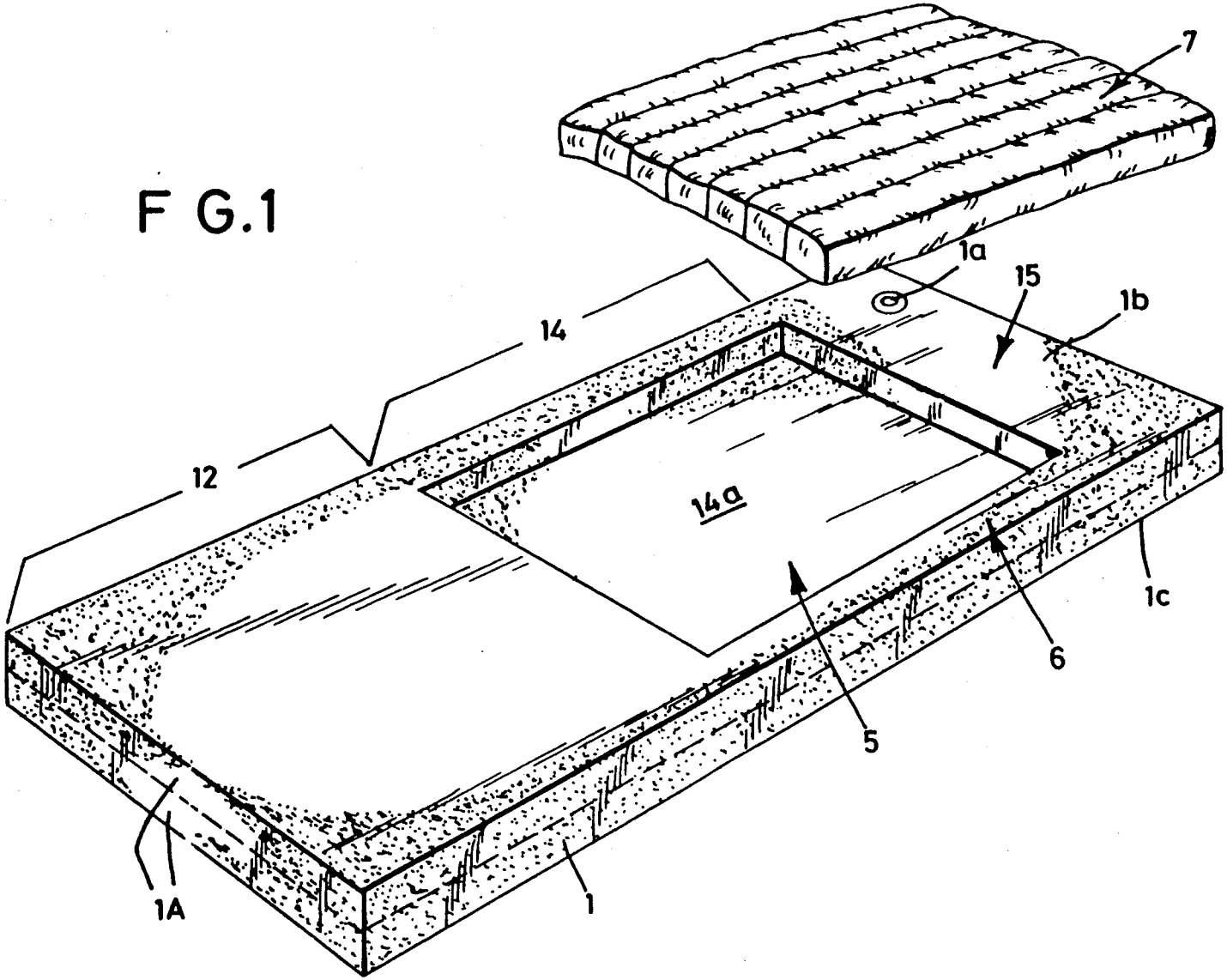
FIG. 1 is an exploded perspective view of a portion of a mattress which embodies one form of the invention.
Figure 2:
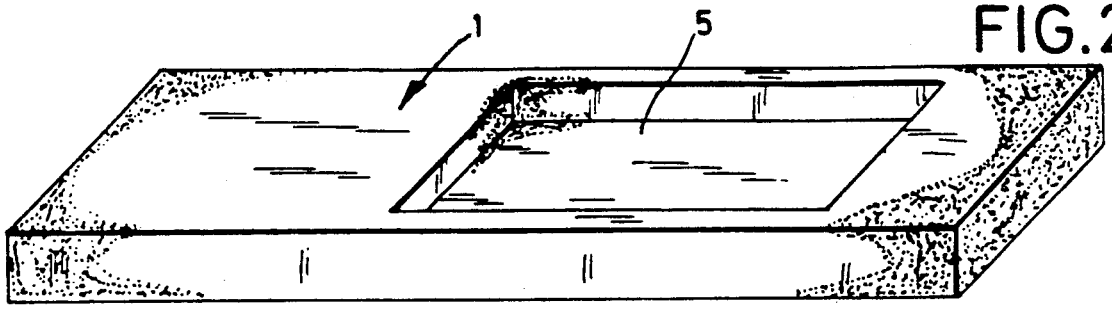
FIG. 2 is a perspective view of a base which is somewhat different from the base of FIG. 1.

The mattress which is shown in FIG. 1 comprises a flat elongated rectangular base 1 having a leg supporting end portion 12 at the foot end, a head supporting end portion 15 at the head end, and a torso supporting portion 14 between the end portions 12 and 15. The length of the intermediate portion 14 preferably equals or slightly or even considerably exceeds the length of the backbone of a grown up person, e.g., approximately 90 cm. The base 1 is made of one piece and preferably consists of polyurethane foam or of a mixture of hollow fibers having channels extending all the way from end to end of each fiber. The weight of the base 1 is relatively low irrespective of the selection of its material; this is desirable and advantageous for convenience of manipulation. Moreover, a base which is made of polyurethane foam or of a mixture of tubular fibers produces no dust or negligible quantities of dust which is important to patients or to persons in charge who are allergic to dust. A base which is made of polyurethane foam can be provided with an array of equally or non-uniformly distributed annular holes (one shown at 1*a* in FIG. 1) which extend from the upper side 1*b* toward the underside 1*c* and/or in the opposite direction and enhance the climatizing action of the material of the base. An additional advantage of a base which is made of polyurethane foam is that it can be readily flexed and folded for the purposes of inversion, for storage or for other reasons.

The base 1 serves to support the entire body of an occupant but the torso of such person is directly supported by a rectangular insert 7 which is removably receivable in a complementary socket or recess 5 provided in the upper side 1*b* and extending into the intermediate portion 14. The length of the recess 5 and insert 7 preferably at least matches the full length of the spinal column of the occupant. If the base 1 is made of fibrous material, the intermediate portion 14 is very hard all the way or practically all the way around the recess 5 is contrast to the portion 12 and 15 which are softer or even much softer than the intermediate portion 14. For example, the apparent or bulk density of the intermediate portion 14 around the recess 5 can be in the range of 60 kg/m$^3$, and the bulk density of the end portions 12, 15 can be considerably less, e.g., approximately 40 kg/m$^3$.

At least one of the longitudinally extending marginal sections 6 of the base 1 is preferably hard or even very hard, particularly at one or both sides of the recess 5 all the way between the portions 12 and 15. This contributes to the comfort of the person sitting on the mattress, at least in part on one of the marginal sections and, if more comfortable, in part on the adjacent portion of the insert 5.

If the base 1 is made of polyurethane foam, the crushing- or compression-resistance of the intermediate portion 14 preferably exceeds the resistance of the portions 12, 15 to thus contribute to convenience of the occupant, i.e., the portions 12 and 15 are softer than the portion 14.

The mattress further comprises a cover 8 (FIG. 5) which preferably completely surrounds and confines the base 1 and the insert 7 in the recess 5. The cover 8 can be provided with three pairs of slide fasteners (not specifically shown) to afford convenient access to its contents.

It is presently preferred to make the insert 7 in one of at least three different ways, depending on the intended purpose of the mattress. It is further preferred to supply the base 1 jointly with two or more different inserts 7.

Figure 3:
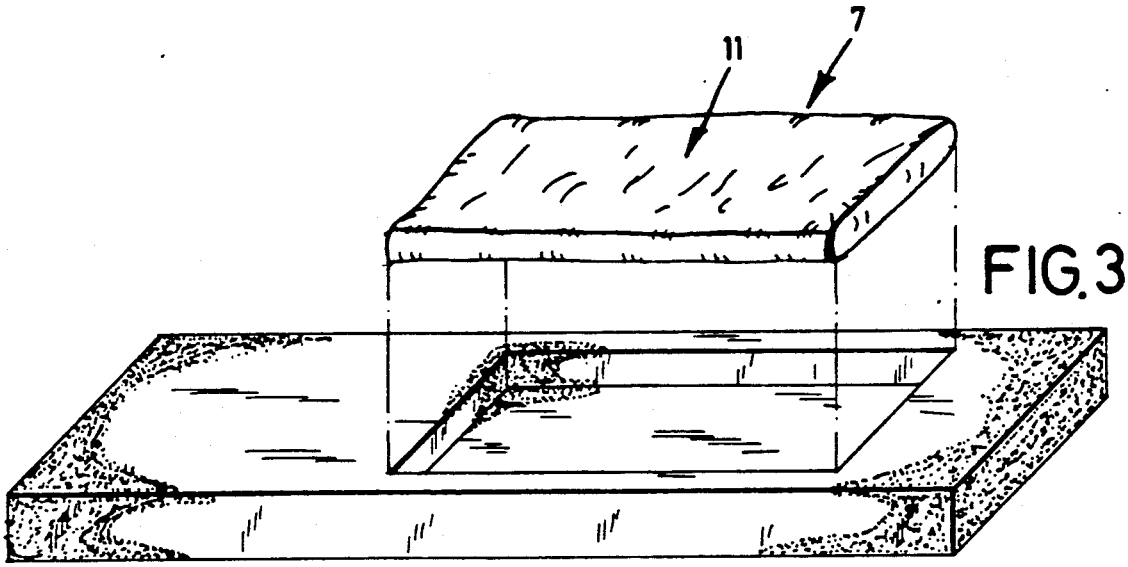
FIG. 3 is a perspective view similar to that of FIG. 1 but showing a different insert.

In accordance with a first embodiment, the insert 7 comprises an envelope 11 (FIG. 3) which contains a filler consisting of a supply of fragments of polyurethane foam, e.g., rods of polyurethane foam which are cut to assume a substantially rhomboidal shape (see FIG. 6). Each such fragment is provided with a large number of gas-filled (normally air-filled) pores.

Figure 4:
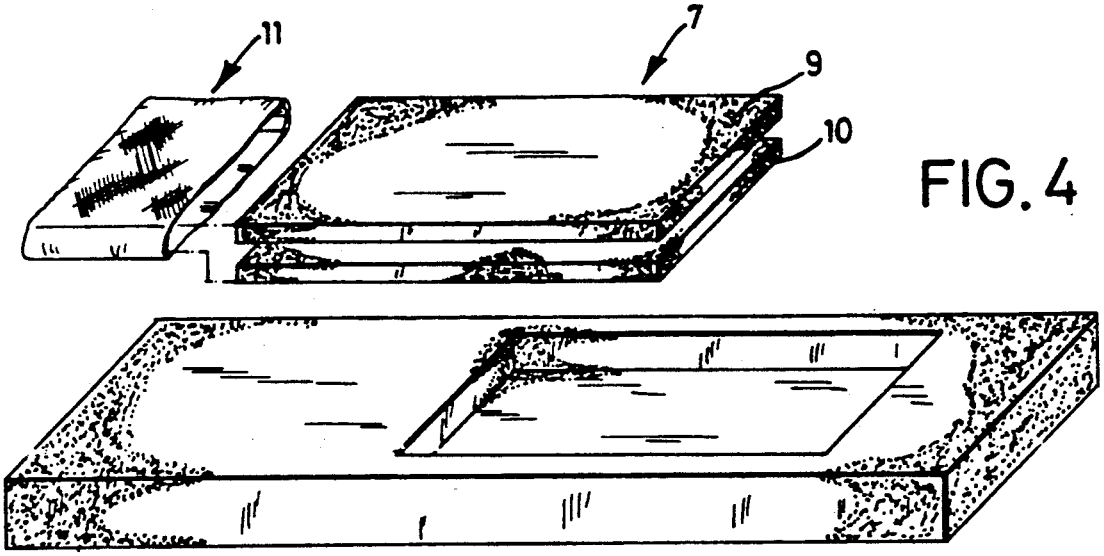
FIG. 4 is a perspective view similar to that of FIG. 3 but showing the insert in an exploded perspective view.

In accordance with a second embodiment, the envelope 11 contains a different filler, namely two layers 9 and 10 (FIG. 4) of polyurethane foam. The bulk density and the hardness of one of these layers (particularly the lower layer 10) can exceed the corresponding parameters of the other layer. The two layers are designed to progressively conform to each other. Each layer is preferably formed with punch cuts which can extend from the upper side to the underside of the respective layer. Such punch cuts are preferably spaced from each other and are preferably straight. Reference may be had to the aforementioned commonly owned U.S. Pat. No. 4,777,681 wherein various arrays of punch cuts are shown in each of FIGS. 1 to 8. It is preferred to distribute the punch cuts in such a way that the neighboring punch cuts are normal to each other and extend from the upper side to the underside at least substantially at right angles to the general plane of the respective layer. The layers 9 and 10 are spot welded or lineary connected to each other as a result of the application of pressure and/or heat.

In accordance with a further embodiment, the envelope 11 of an insert 7 can contain a filler consisting (a) of a mixture of substantially rhomboidal fragments of subdivided (severed) rods of polyurethane foam with a number of gas-filled pores and (b) of polypropylene beads (see FIGS. 7 and 8).

Figure 5:
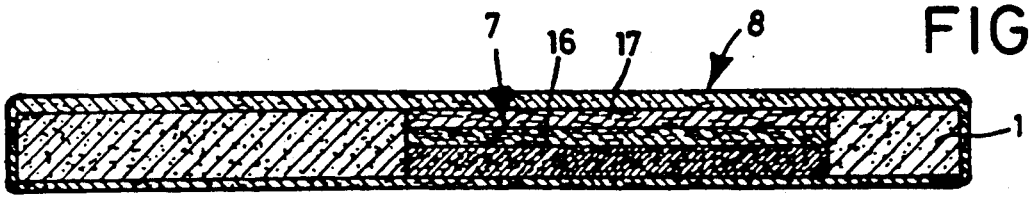
FIG. 5 is a central longitudinal sectional view of a further mattress.

FIG. 5 shows that the insert 7 can consist of two discrete parts, namely a lower cushion 16 and a superimposed upper cushion 17. Each of these cushions can constitute a slab of polyurethane foam, a slab of polyurethane foam in an envelope, fragments of polyurethane foam in an envelope or a mixture of fragments of polyurethane foam and polypropylene beads in an envelope.

It is further within the purview of the invention to employ an insert which includes or constitutes at least one liquid-filled (e.g., water-filled) or a gel-filled cushion.

The selected insert 7 contributes to the comfort of the occupant of the improved mattress in that the recess or socket 5 can receive an insert which is best suited for a particular purpose, i.e., to enhance the comfort of an elderly person, of a convalescent or of a healthy person who is more comfortable with a relatively soft or relatively hard insert in the region between her or his head and the lower extremities. Irrespective of the selection of a specific insert, it is invariably preferred to ensure that the construction of the mattress is based on the orthopedically correct principle which involves the provision of softer head and leg supporting end portions 15, 12 and a relatively hard torso supporting intermediate portion 14 (inclusive of the insert 7). The elasticity of the intermediate portion 14 with insert 7 is preferably selected in such a way that the stressed regions of the portion 14 plus insert 7 do not yield to a considerable extent but ensure that the stressed parts are molded or formed to conform to the shape of the corresponding portion of the torso while affording adequate support. It is further important to ensure that the base 1 is not likely to vibrate when the mattress is in use and that the deformation of a particular part does not entail gradually decreasing repeated up and down movements.

In a presently preferred base 1, the width of the marginal sections 6 is in the range of 7 to 13 cm, preferably about 10 cm. The depth of the recess 5 can be between 5 and 9 cm, preferably about 7 cm, the length of the recess between the end portions 12 and 15 can be between 70 and 110 cm, preferably about 90 cm, and the width of the recess between the marginal sections 6 can be between 50 and 90 cm, preferably about 70 cm. It has been found that a recess or socket 5 having a depth of about 7 cm suffices to ensure that the insert 7 in such recess can adequately influence the characteristics of the intermediate portion 14 inclusive of the insert when the mattress embodying a base 1, and insert 7 and a cover 8 is in use.

The upper side **1*b* of the base 1 is preferably roughened to exhibit desirable non-skid characteristics. For example, the upper side lb can have a napped finish (see FIG. 4), the same as the bottom surface 14*a* of the intermediate portion 14 in the recess 5. Such bottom surface is preferably slightly convex. Roughening of the upper side 1*b* of the base 1 and preferably also of the envelope 11 of the insert 7** is desirable on the additional ground that this promotes ventilation of the corresponding parts of the mattress.

The cover 8 for the base 1 and the insert 7 in the recess 5 can be made of webs of foamed material. Since the cover 8 completely surrounds the base 1 and the insert 7 in the recess 5, the finished mattress is actually a coherent structure wherein the base and the insert are fully concealed in actual use of the mattress. The web or webs of foamed material can be confined in an outer layer of textile or other material which is comfortable to the skin and which is secured to the web or webs of foamed material by longitudinally extending quilting or by other forms of stitching. It is preferred to provide the cover 8 with an elastic outer layer to ensure that the aforediscussed desirable characteristics of the base 1 and insert 7 can be put to use and are not counteracted or rendered ineffective by an excessively stiff and nonyielding outer layer for the foamed web material of the cover 8. Moreover, the development of wrinkles, folds and/or other irregularities is much less likely if the outer layer of the cover 8 is made of an elastic material. As mentioned above, the cover 8 can be provided with two-piece slide fasteners, preferably along three of its edges, to facilitate rapid removal of the base 1 and/or insert 7 as well as convenient insertion of a base and/or an insert.

Relatively hard and stiff marginal sections 6 are desirable and advantageous when the mattress is to be occupied by a patient who is to perform various exercises in order to recover the mobility of her or his extremities and such exercises are to be carried out while the patient is sitting on the edge of the mattress, at least partly on the one or on the other marginal section 6. Relative stiffness or rigidity of the entire intermediate portion 14 (with the insert 7 properly confined in the recess 5), is desirable in order to afford adequate comfort for the entire backbone.

An advantage of a base 1 which is made of polyurethane foam is low cost and long useful life, even if certain portions of the base are subjected to long-lasting and repeated deforming (compressive) stresses. Furthermore, the gas-containing pores of polyurethane foam contribute to the conditioning effect of the base, and such conditioning effect can be enhanced still further by the provision of properly arrayed holes 1*a*. These holes are preferably distributed all over the upper side 1*b* of the base 1.

If the base 1 is made of hollow fibers, the fibers are normally crimped or curled and each thereof can be provided with one or more (particularly four) channels. Such channels contribute to elasticity of the fibers without unduly affecting their stability. Moreover, the channels render the fibers permeable to air and water vapors. A base 1 which is made of hollow fibers can be assembled of two or more layers (two layers are shown at 1A in FIG. 1) which are thermally bonded to each other and are reinforced in the region around the recess 5 to enhance the stability of the intermediate portion 14 of the base. This results in the provision of a base which is at least reasonably resistant to flexing, at least in the region of the intermediate portion 14, but is capable of elastically yielding in response to the application of compressive stresses. Thus, the base 1 can yield in response to the application of pressure but will not readily bend and it will not sag. Such types of bases can be used with particular advantage in the mattresses for use by patients requiring a highly satisfactory support for the spinal column.

An insert 7 wherein the textile envelope 11 confines a supply of preferably rhomboidal fragments of polyurethane foam with a plurality of gas-containing pores exhibits the advantage that it is highly elastic and offers much comfort to the torso of a patient or of any other person occupying the mattress which employs such an insert. An insert of this character will be preferred by many patients who are confined in bed for long periods of time because the patients are less likely to develop bed sores. However, such insert can also be utilized with considerable advantage in the mattresses of persons suffering pains due to rheumatism and certain other illnesses. A person occupying a mattress with an insert which contains fragmentized polyurethane foam finds a soft support for the torso and finds additional comfort as a result of continuous circulation of air in the pores of the fragments in the envelope 11. The occupant has the sensation of comfortable constant dry heat without a buildup of temperature peaks and without cold spots. In spite of its relative softness, such insert offers adequate support for the spinal column of the occupant and prevents the torso of the occupant from "sinking" into the mattress which is of advantage when a bedridden patient requires help from an attendant.

An important advantage of the improved mattress is that it can be readily assembled to suit the needs and desires of a particular user, such as a patient in a hospital, a nursing home, a convalescent home or a similar establishment. At the same time, all parts which should be readily accessible for inspection, cleaning and/or sterilizing for sanitary and/or other reasons are readily accessible. In addition, the parts of the improved mattress are simple, they can be mass produced of readily available inexpensive materials, and they can be stored (either individually or in partly or fully assembled condition) in a small area. For example, the assembled mattress (i.e., the filled cover 8) can be readily manipulated by a single person, and such mattress can be folded or rolled up for convenient storage or transport.

A particular insert 7 will be selected on the basis of instructions from a physician or based on the preferences of a healthy individual. Irrespective of the nature of the selected insert 7, it is desirable and advantageous to reinforce (stiffen) the intermediate portion 14 of the base 1 around the recess 5 in order to establish a certain hardness in the region which is to support the torso and the backbone of the occupant while the leg supporting end portion 12 is normally softer, the same has the head supporting end portion 15. The rather pronounced hardness or rigidity of at least one marginal section 6 of the base (particularly adjacent the recess 5) has been found to be desirable and comfortable to many users, primarily because this enhances the comfort of a person sitting on the relatively hard and stiff marginal section 6.

The improved mattress can be said to embody the features of a relatively hard mattress for orthopedically correct support of the occupant and the advantages of a relatively soft mattress with attendant comfort to and tissue-relaxing occupancy by a user. The mattress can be used with particular advantage in hospitals and in similar establishments because it can be conveniently manipulated by an attendant to be sanitized and/or converted to satisfy the specific needs of a patient or convalescent. Proper selection of certain characteristics of the mattress will promote the healing process and will facilitate the accomplishment of therapeutic and other health care goals without causing bed sores and/or other undesirable consequences of prolonged confinement to bed.

The thickness or height of the base 1 around the recess 5 need not exceed twice the depth of the recess. For example, the thickness or height of the base 1 can be in the range of 11–17 cm, preferably about 14 cm.

An insert which comprises a plurality of layers (such as 10, 11) having different specific gravities (i.e., different weights per unit volume) and different resistances to crushing or compression exhibits the advantage that its elasticity can be selected with a very high degree of accuracy. This, in turn, renders it possible to ensure a "metered" or accurately determined extent of penetration of the torso of an occupant into the insert. The initial sensation of a person who is in the process of lying down on the mattress is that of softness and comfort but, as the torso continues to sink into a multiple-layered insert of the above outlined character, the resistance to further sinking or descent of the torso increases and the sinking is terminated when the hard material of the intermediate portion around the recess 5 takes over the task of carrying the weight of the torso on the deformed insert 7. Such "yieldable supporting effect" can be enhanced by raising the localized (substantially point-type) elasticity of the insert, i.e., the foamed material of the insert will or should yield only in the very region where it is subjected to a deforming stress but not in the area around such region. For example, the arrangement may be such that a person resting on her or his back will cause the buttocks to effect a rather pronounced deformation of the adjacent portion of the insert but the lumbar vertebrae will remain adequately supported. If the occupant lies on one side, one hip and one of the shoulders will be permitted to sink deeper into the insert but the backbone will be substantially straight with possible slight stretching in the region of lumbar vertebrae.

The aforediscussed advantages of a properly selected insert will entail controlled relaxation, superior support and (if necessary) some slight stretching of certain parts of the torso to thus ensure superior material change of intervertebral discs and to contribute to rapid recovery of the person occupying the improved mattress.

The cover 8 can include webs which are made of foamed material and have a thickness of 10–20 mm, preferably about 15 mm. Reference may be had to the aforementioned commonly owned European Pat. No. 0 236 668. The feature that the outer layer of such cover is made of a material which does not irritate and/or otherwise adversely affect the skin also contributes to the comfort of an occupant of the mattress. Longitudinal quilting, as a means for connecting the outer layer to the webs of foamed material which form part of the cover 8, is the presently preferred mode of completing the making of the cover. As mentioned above, the outer layer is preferably elastic (the same as the webs of foamed material therein) in order not to counteract the beneficial effects of selective elasticity of the other two parts (1 and 7) of the improved mattress. Moreover, adequate elasticity of the cover 8 reduces the likelihood of the development of wrinkles, fold lines and other irregularities which could be uncomfortable to the occupant and could detract from the appearance of the mattress.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A mattress comprising a base including a head supporting first end portion, a relatively soft leg supporting second end portion and a relatively hard torso supporting intermediate portion, said base having an upper side and a recess provided in said upper side within said intermediate portion and said intermediate portion including two substantially rigid lateral sections flanking said recess between said end portions; an insert removably received in and at least substantially filling said recess; and a cover surrounding said base and said insert.

2. The mattress of claim 1, wherein said base is of one piece and said lateral sections have a width in the range of 5–15 cm, particularly about 10 cm.

3. The mattress of claim 1, wherein said base contains polyurethane foam.

4. The mattress of claim 1, wherein said base contains hollow fibers.

5. The mattress of claim 1, wherein said base has an array of annular holes in said upper side.

6. The mattress of claim 1, wherein said base comprises a plurality of thermally interconnected superimposed layers of hollow fibers.

7. The mattress of claim 1, wherein said intermediate portion of said base has a slightly convex bottom surface in said recess.

8. The mattress of claim 1, wherein said base has a height of 11–17 cm, particularly about 14 cm, and said recess has a substantially rectangular outline.

9. The mattress of claim 8, wherein said recess has a length of about 90 cm between said end portions of said base, a width of about 70 cm, and a depth of about 7 cm.

10. The mattress of claim 1, wherein said upper side of said base is rough.

11. The mattress of claim 1, wherein said intermediate portion of said base has a rough bottom surface in said recess.

12. The mattress of claim 1, wherein said upper side of said base has a napped finish.

13. The mattress of claim 1, wherein said intermediate portion of said base has a bottom surface in said recess and said bottom surface has a napped finish.

14. The mattress of claim 1, wherein said insert includes a textile envelope and a supply of fragments consisting of polyurethane foam in said envelope.

15. The mattress of claim 14, wherein at least some of said fragments have a substantially rhomboidal shape and have a plurality of gas-filled pores.

16. The mattress of claim 1, wherein said insert includes a plurality of layers consisting of foamed material and having different bulk densities.

17. The mattress of claim 16, wherein said layers have different hardnesses and include neighboring first and second layers which progressively conform to each other.

18. The mattress of claim 1, wherein said insert includes a lower layer having a first specific gravity and an upper layer having a lower second specific gravity and overlying said lower layer.

19. The mattress of claim 18, wherein said layers consist of foamed material and have spaced-apart portions which are connected to each other, said insert further comprising an envelope for said layers.

20. The mattress of claim 19, further comprising at least one row of stitches connecting said envelope to at least one of said layers.

21. The mattress of claim 1, wherein said insert includes a filler and an elastic envelope for said filler.

22. A mattress comprising a base including a head supporting first end portion, a relatively soft leg supporting second end portion and a relatively hard torso supporting intermediate portion, said base having an upper side and a recess provided in said upper side within said intermediate portion; an insert removably received in and at least substantially filling said recess, said insert comprising a textile envelope and a supply of fragments of polyurethane foam and polypropylene beads; and a cover surrounding said base and said insert.

23. The mattress of claim 22, wherein said beads are intermixed with said fragments, said fragments having a plurality of gas-filled pores and at least some of said fragments having a substantially rhomboidal shape.

* * * * *